US007611389B2

(12) United States Patent
Toivanen et al.

(10) Patent No.: US 7,611,389 B2
(45) Date of Patent: Nov. 3, 2009

(54) CONNECTOR

(75) Inventors: Seppo Toivanen, Klaukkala (FI); Yoshitaka Arai, Gunma (JP)

(73) Assignee: Yokowo Co., Ltd., Tokyo (JP)

( * ) Notice: Subject to any disclaimer, the term of this patent is extended or adjusted under 35 U.S.C. 154(b) by 690 days.

(21) Appl. No.: 10/582,365

(22) PCT Filed: Dec. 3, 2004

(86) PCT No.: PCT/FI2004/000736

§ 371 (c)(1),
(2), (4) Date: Jun. 9, 2006

(87) PCT Pub. No.: WO2005/057733

PCT Pub. Date: Jun. 23, 2005

(65) Prior Publication Data

US 2007/0141906 A1 Jun. 21, 2007

(30) Foreign Application Priority Data

Dec. 10, 2003 (FI) ..... 20031804

(51) Int. Cl.
*H01R 13/24* (2006.01)

(52) U.S. Cl. ..... 439/700

(58) Field of Classification Search ..... 439/700, 439/246, 247, 248; 324/761
See application file for complete search history.

(56) References Cited

U.S. PATENT DOCUMENTS 4,397,519 A * 8/1983 Cooney ..... 439/824
5,749,754 A * 5/1998 Patterson et al. ..... 439/824
7,094,112 B2 * 8/2006 Arai et al. ..... 439/700
2005/0130507 A1 * 6/2005 Arai et al. ..... 439/700

FOREIGN PATENT DOCUMENTS

| | | |
|---|---|---|
| JP | 2003-217726 | 7/2003 |
| WO | 02/27870 | 4/2002 |
| WO | 03/005042 | 1/2003 |
| WO | 03/005043 | 1/2003 |

* cited by examiner

*Primary Examiner*—Neil Abrams
*Assistant Examiner*—Phuong Nguyen
(74) *Attorney, Agent, or Firm*—Morgan, Lewis & Bockius LLP

(57) ABSTRACT

The invention relates to a connector comprising a housing, a spring biased contact surface facing in a front direction of said connector for establishing a contact with a connector counterpart, said contact surface being movable within a working area against a spring force from a first rest position to a second connecting position by a force directed to the contact surface upon establishing a contact with the connector counterpart. In order to achieve a connector which makes it possible to keep the contact force at an appropriate and substantially constant level, said connector comprises a rolled spring with an outer end protruding in said front direction of said connector; said protruding end is attached to the housing of said connector, whereby said rolled spring is at least partly unrolled when said contact surface is moved against the spring force.

9 Claims, 3 Drawing Sheets

CONNECTOR

BACKGROUND OF THE INVENTION

1. Field of the Invention

This invention relates to a connector with a spring biased contact surface, which is movable against the spring force when a force is directed to the contact surface upon establishing a contact with a connector counterpart. The phrase 'spring biased contact surface' refers in this application to a solution where the force of a spring is used to return the contact surface to a first rest position, when the contact surface is located somewhere else than in said rest position.

2. Description of the Prior Art

Previously there is known a connector with a helical spring arranged inside the connector body. One such prior art connector 1 is shown in FIG. 1. This connector 1 comprises a housing 2 and a contact part 3 which is movable in relation to the housing 2 in the direction shown by the arrow. The housing 2 contains a helical spring 4, which presses a rear end of the contact part 3. A force directed to the contact surface 5 of the contact part 3, upon establishing a contact with a connector counterpart, will move the contact part 3 to the left in FIG. 1, against the spring force of the spring 4.

A problem with the prior art connector shown in FIG. 1 is that the spring force increases with the travel distance of the contact surface 5 from the rest position shown in FIG. 1. In other words, the spring force is at its lowest minimum when the contact surface 5 is located in the rest position, and the highest maximum is reached when the contact surface 5 has been moved to the left as much as possible in FIG. 1. This increase in the spring force has the disadvantage that the contact force between the contact surface 5 and the contact surface of a connector counterpart varies. Such a variation of the contact force is not acceptable because it affects the electrical performance of the connector. Another problem with a variation in the contact force is that the contact force may increase to a level where the plating of the contact surface 5 is damaged.

SUMMARY OF THE INVENTION

An object of the present invention is to solve the above mentioned drawback and to provide a connector with a construction that makes it possible to keep the contact force at an appropriate and substantially constant level over the entire working area.

Another object of the present invention is to provide a connector whose working area can be increased as compared with the working area of prior art connectors while the contact force is kept at an appropriate and substantially constant level.

The above mentioned and other objects of the present invention are achieved with the connector as defined in independent claim 1.

The invention is based on the idea of utilizing a rolled spring in a connector. An outer end of this rolled spring is attached to the housing of the connector, while the remaining "roll" of the spring is allowed to move in the housing. Thus when the contact surface of the connector moves within the working area in a direction against the spring force of the rolled spring, the rolled spring is at least partly unrolled. The advantage obtained is that the spring force of the spring does not substantially increase with the distance, but instead the spring force remains substantially constant within the working area. A constant spring force ensures that the contact force and the electrical performance of the connector substantially remain constant, and that no such increase occurs in the spring force which could damage the plating of the contact surface.

The outer end of the rolled spring can be attached to the housing of the connector in different ways. One alternative is to bend the outer part such that it obtains a hooked shape, which can grip a suitable part of the housing. Alternatively the outer end of the rolled spring can be attached to the housing, for instance, by gluing or by ultrasonic welding.

Preferred embodiments of the connector are disclosed in the attached dependent claims 2 to 9.

BRIEF DESCRIPTION OF THE DRAWINGS

In the following, the present invention will be described in closer detail by way of example and with reference to the attached drawings, in which.

DESCRIPTION OF PREFERRED EMBODIMENTS

Figure 1:
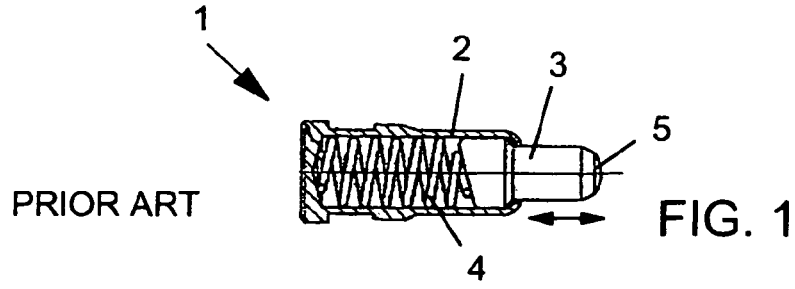
FIG. 1 illustrates a prior art connector.
Figure 2:
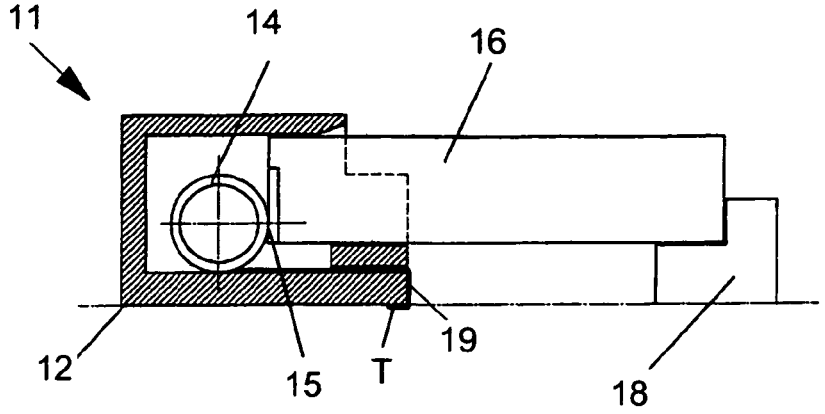
FIG. 2 illustrates a first preferred embodiment of a connector.

FIG. 2 illustrates a first preferred embodiment of a connector 11 according to the present invention. The connector 11 comprises a housing 12 wherein a rolled spring 14 is arranged. In this embodiment, the contact surface 15 of the connector consists of the surface of the spring. This contact surface can have a plating of a suitable material in order to improve the electrical connectivity of the connector. One alternative is to provide the contact surface with a coating including, for instance, copper (Cu), nickel (Ni) or gold (Au).

It is by way of example assumed that the connector shown in FIG. 2 is a battery connector for a mobile telephone. The housing 12 of the connector 11 is open towards the front direction of the connector. This opening makes it possible to arrange a battery 16 in the connector 11 such that a connector counterpart of the battery is pushed towards the contact surface 15 of the connector 11, against the spring force. An outer end 19 of the rolled spring 14 protrudes from the spring in the front direction of the connector 11. This outer end 19 is attached to the housing 12 of the connector 11 such that it has been bent into a hooked shape, which grips an outer surface of the housing 12. Thus, when the connector counterpart of the battery is pushed against the contact surface 15, the rolled spring 14 rotates in the housing 12 such that it is at least partly unrolled. When the battery 16 is attached to the connector, a first end of it is supported by the housing 12 of the connector 11, and a second end by a support 18. The connector 11 and the support 18 are both attached to a circuit board.

In the example of FIG. 2, the protruding end 19 of the spring also forms a terminal T to be used for wiring the connector to the circuit board. In that case, the terminal T on the end 19 can, for instance, be soldered to the circuit board. The spring 14 thus provides the electrical path between the connector counterpart in the battery 16 and the circuit board.

The spring force needed in a practical implementation of a battery connector is typically within the range of 0.5N to 1.5N, preferably 0.7N to 1.0N. The needed working area, in other words the distance the contact surface 15 needs to move, is typically 5 to 10 mm at maximum. However, in many implementations less than 2 mm is sufficient.

An advantage of utilizing a rolled spring in the connector of FIG. 2 is that the spring force remains substantially constant throughout the entire working area. Thus, the spring force is in practice the same when the roll of the rolled spring is located as much to the right as possible in the housing 12 (when the contact surface is located in its first rest position), as it is if the roll of the rolled spring is located as much to the left as possible in the housing. In FIG. 2, the spring is shown in a situation where the contact surface is located in its second contact position.

A rolled strip spring can be used as the spring in a connector according to the present invention. One alternative is also to use a so-called constant force spring in order to obtain a substantially constant spring force within the working area. Thus, the contact force can efficiently be kept at a controlled constant level, which ensures that the electrical performance of the connector 11 remain constant and that the plating on the contact surface 15 does not wear too much during use. One previously known type of a constant force spring, which can be used in the present invention, is rolled strip spring commercially available from Lesjöfors Stockholms Fjäder AB, Jämtlandsgatan 62, SE-162 20, Vällingby Sweden (www.lesioforsab.com). However, also other types of constant force springs can be used in the invention.

In FIG. 2, it is by way of example assumed that the rolled spring 14 is arranged in the connector housing 12 in such a position that the center axis of the roll is substantially parallel with the surface of the circuit board. However, it is also possible to construct the connector such that the center axis of the roll is not parallel with the circuit board, but instead it forms an angle with the surface of the circuit board. Such an angle can be even 90°.

Still another possibility is to provide the roll of the rolled spring with a center shaft around which the rolled strip is rolled. In such a case two grooves are formed within the opposite walls of the housing along with the travel of the rolled spring in order to allow the ends of the center shaft protruding from the opposite sides of the rolled spring to be guided within the housing. In this case it is also possible to utilize the surface of the shaft as the contact surface of the connector, in which case an electrical connection to a connector counterpart is established via the surface of the shaft.

Figure 3:
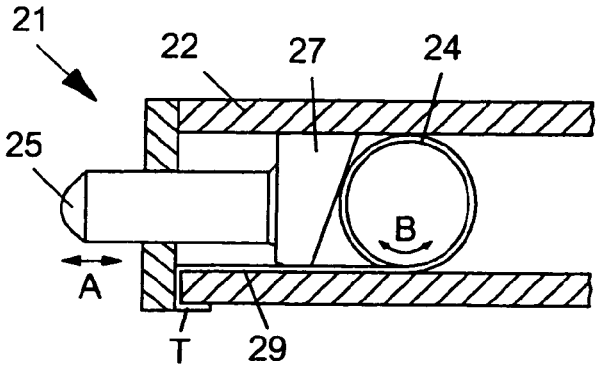
FIG. 3 illustrates a second preferred embodiment of a connector.

FIG. 3 illustrates a second preferred embodiment of a connector. The embodiment of FIG. 3 is very similar to the one explained in connection with FIG. 2. Therefore, the embodiment of FIG. 3 will in the following be explained mainly by pointing out the differences between these embodiments.

In FIG. 3, the connector 21 includes a movable contact part 27. The contact surface 25 consists of a front part of the contact part and the rolled spring 24 presses against a rear part of the contact part 27. Similarly, as in FIG. 2, an outer end 29 of the rolled spring 24 protrudes in the front direction of the connector 21, and this end 29 is attached to the housing 22 of the connector. The end 29 is bent to form a hook which grips the housing in order to accomplish the attachment. Thus, as the contact part 27 moves in relation to the housing 22 (direction of movement indicated by arrow A), the roll of the spring 24 rotates as indicated by arrow B. The terminal T which is used for connecting the connector to an electrical wire or to a circuit board is formed at the hooked-shaped end 29.

The rear part of the contact part 27 is in the embodiment of FIG. 3 inclined such that when the spring 24 presses the rear part, the rear part of the contact part presses sideways towards the connector housing 22. This arrangement makes it possible to have a separate conductive path (as in FIG. 5) along the inner wall of the connector housing (at the location towards which the contact part is pressed), and to ensure that a sufficient electrical contact is established between the contact part 27 and the electrical path.

Figure 4:
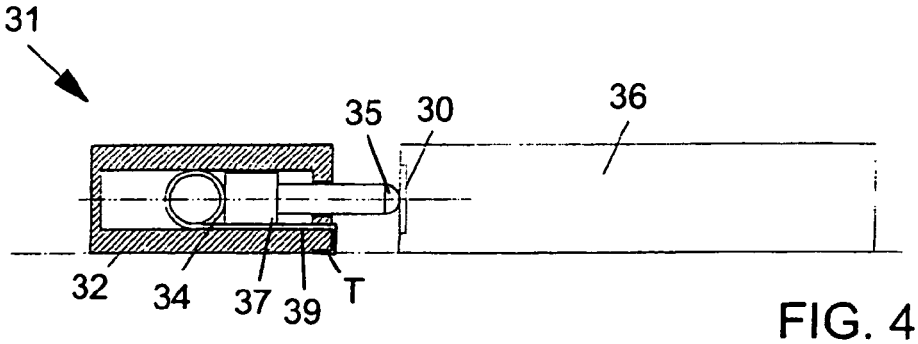
FIG. 4 illustrates a third preferred embodiment of a connector.

FIG. 4 illustrates a third preferred embodiment of a connector. The embodiment of FIG. 4 is very similar to the one explained in connection with FIG. 3. Therefore, the embodiment of FIG. 4 will in the following be explained mainly by pointing out the differences between these embodiments.

The connector 31 of FIG. 4 is by way of example assumed to be a battery connector for a mobile phone. Thus the contact surface 35 on the contact part 37 is in FIG. 4 connected to the connector counterpart 30 of the battery 36. The rolled spring presses against the rear part of the contact part 37. In this embodiment, the rear part has a flat surface which forms a 900 angle with the surface of the circuit board.

The attachment between the protruding end 39 of the rolled spring and the housing 32 is also in FIG. 4 accomplished by bending the end into a hooked-shape. The terminal T which is used for connecting the connector to an electrical wire or to a circuit board is formed at the hooked-shaped end 39.

Figure 5:
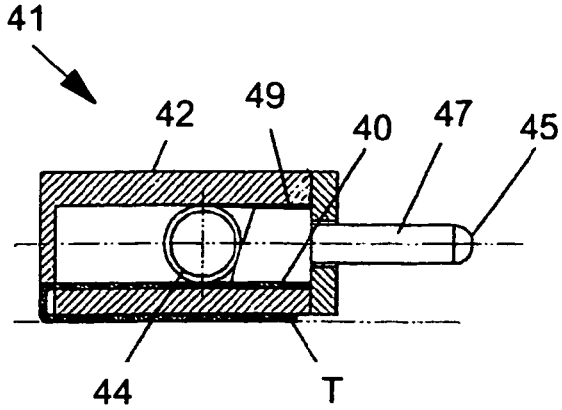
FIG. 5 illustrates a fourth preferred embodiment of a connector.

FIG. 5 illustrates a fourth preferred embodiment of a connector. The embodiment of FIG. 5 is very similar to the one explained in connection with FIG. 3. Therefore, the embodiment of FIG. 5 will in the following be explained mainly by pointing out the differences between these embodiments.

In FIG. 5, a separate conductive path 40 is arranged along an inner wall of the housing 42 in addition to the rolled spring 44. The conductive path can, for instance, consist of a metallic strip. An end of the conductive path protrudes to the outside of the connector 41 and forms the terminal T to be used for connecting the connector to a circuit board or to a cable, for instance. Such a conductive path can also be used in any of the other embodiments.

The rear part of the contact part 47 is inclined such that when the spring 44 presses the rear part, the rear part of the contact part presses the conductive path 40. Thus, the electrical connection between the contact surface 45 and the terminal T is provided through the contact part 47 and the conductive path 40.

The use of the separate conductive path 40 means that it is not necessarily required to use the rolled spring 44 for establishing an electrical contact between the connector and the terminal T. This makes it possible to produce the rolled spring from materials which are not electrically conductive, or which have insufficient electrical properties. However, it is of course also possible to use a spring made of an electrically conductive material together with the separate conductive path. In that case the spring will further ensure a sufficient electrical contact between the contact part 47 and the conductive path 40.

In the embodiment of FIG. 5 the end 49 from the rolled spring is not bent into a hooked-shape as in previous embodiments. Instead the end is attached to the inner surface of the housing, for instance, by gluing or by ultrasonic welding. Such a solution can be used also in the other embodiments.

Figure 6:
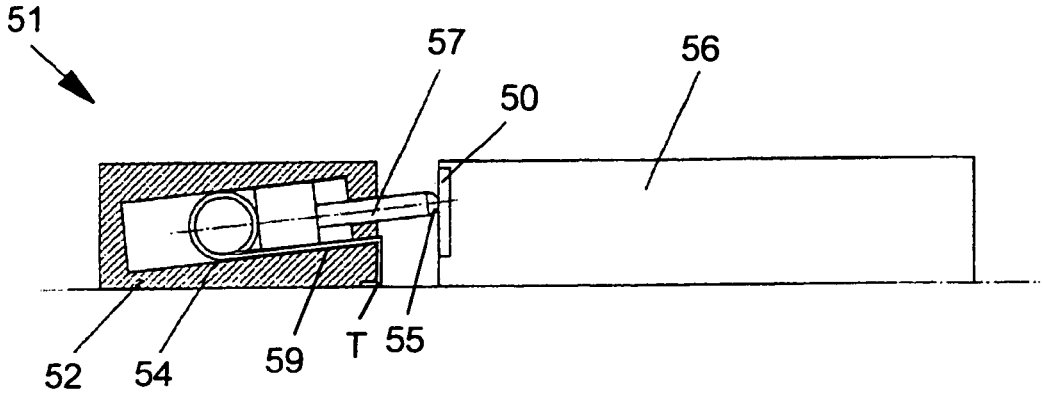
FIG. 6 illustrates a fifth preferred embodiment of a connector.

FIG. 6 illustrates a fifth preferred embodiment of a connector. The embodiment of FIG. 6 is very similar to the one explained in connection with FIG. 4. Therefore, the embodiment of FIG. 6 will in the following be explained mainly by pointing out the differences between these embodiments.

In FIG. 6, the housing 52 of the connector 51 has a cavity which is arranged to form an angle with the surface of the circuit board. Thus, the connecting part 57 and the rolled spring 54 do not move in parallel with the circuit board as in the previous embodiments. The advantage obtained by this embodiment is that a slight scraping is provided between contact surfaces 55 and 50 when a battery 56 is connected to the connector 51. This scraping cleans the contact surfaces and ensures a sufficient electrical contact between the contact surfaces.

The attachment between the protruding end 59 of the rolled spring and the housing 52 is also in FIG. 6 accomplished by bending the end into a hooked-shape. The terminal T which is used for connecting the connector to an electrical wire or to a circuit board is formed at the hooked-shaped end 59.

Figure 7A:
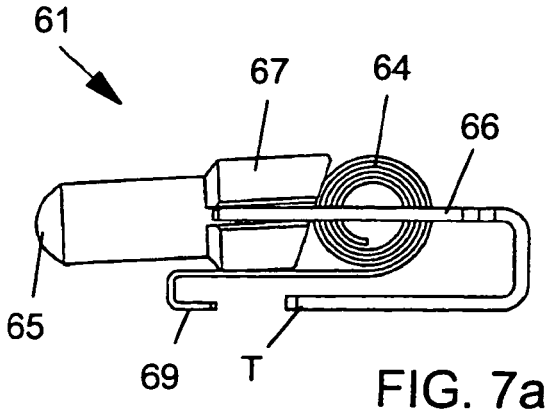
FIGS. 7*a* and 7*b* illustrate a sixth preferred embodiment of a connector.
Figure 7B:
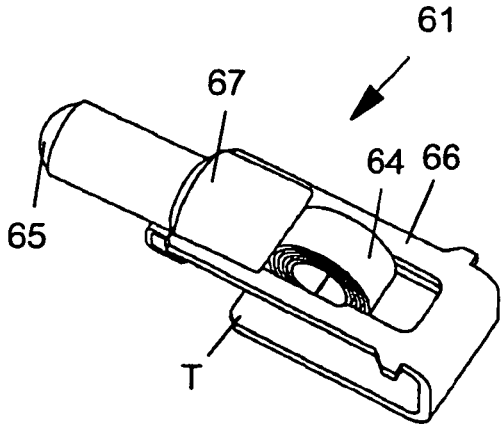

FIGS. 7*a* and 7*b* illustrate a sixth preferred embodiment of a connector. In the embodiment of FIGS. 7*a* and 7*b* the connector 61 has a contact part 67 which is provided with grooves in opposite sides. The connector 61 also includes an intermediate part 66 made of a conductive material and having two parallel protrusions which are arranged into the opposite grooves. The contact part thus travels along these protrusions.

The intermediate part 66 forms a conductive path between the contact part 67 and the terminal T. An advantage with the embodiment of FIGS. 7*a* and 7*b* is that the conductive part has at least two contact points, one on each side (one at each groove). This ensures a sufficient conductive path in each situation between the contact surface 65 on the contact part 67 and the terminal T. The end 69 of the rolled spring 64 is bent into a hooked-shape in order to grip the housing of the connector.

Figure 8A:
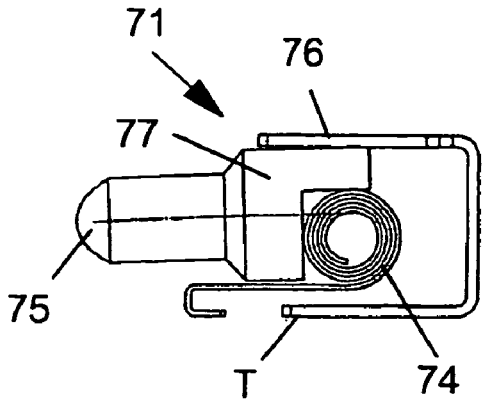
FIGS. 8*a* and 8*b* illustrate a seventh preferred embodiment of a connector.
Figure 8B:
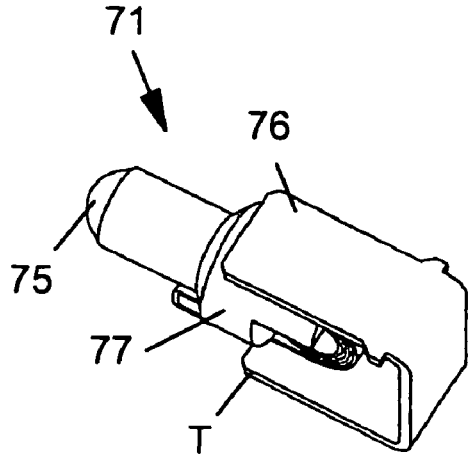

FIGS. 8*a* and 8*b* illustrate a seventh preferred embodiment of a connector 71. The embodiment of FIGS. 8*a* and 8*b* also includes an intermediate part 76 of a conductive material. This intermediate part 76 forms a conductive path between the contact surface 75 of the contact part 77 and the terminal T.

The protruding end 79 of the rolled spring 74 is bent into a hooked-shape in order to grip the housing of the connector.

The intermediate part 76 is generally U shaped, and in the figures the upper inner part of the intermediate part 76 touches the upper side of the contact part 77. The contact part 77 is shaped with an eave, which protrudes over the rolled spring 74. Due to its shape the rolled spring 74 has a restoration force which presses the roll of the spring and the contact part upwards in the figures. Thus a sufficient and stable electrical contact is established between the contact part 77 and the intermediate part 76.

Figure 9A:
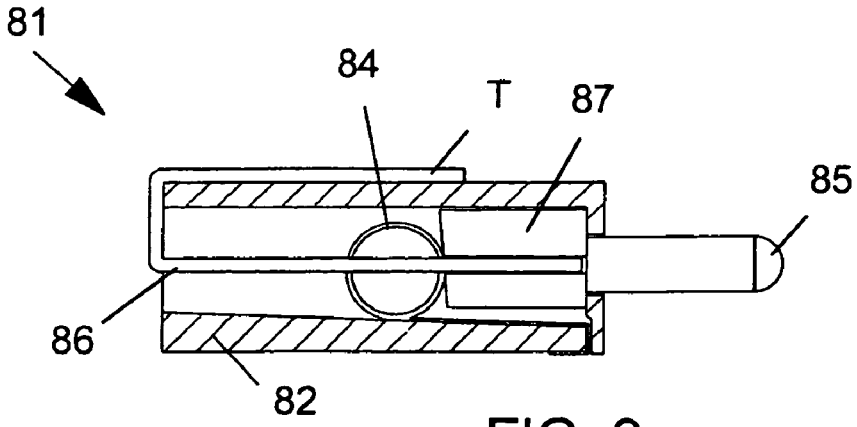
FIGS. 9*a* and 9*b* illustrate an eight preferred embodiment of a connector.
Figure 9B:
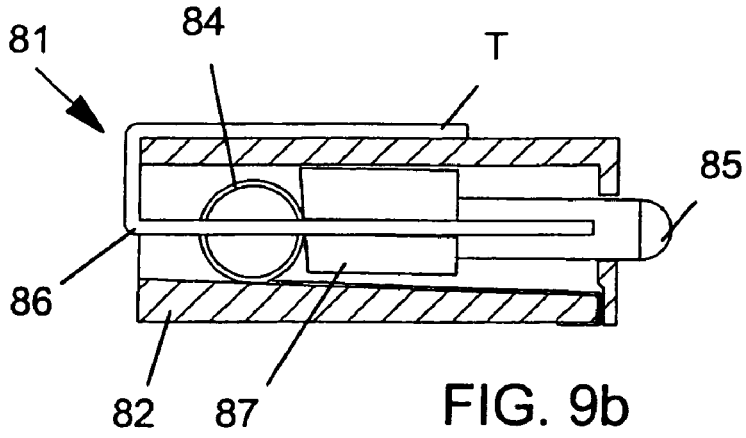

FIGS. 9*a* and 9*b* illustrate an eight preferred embodiment of a connector. The connector 81 of this embodiment is similar as the one shown in FIGS. 7*a* and 7*b*, as it includes an intermediate part 86 having two parallel protrusions which are arranged into opposite grooves of the contact part 87. The intermediate part 86 thus forms a conductive path between the contact surface 85 of the contact part and the terminal T.

In FIGS. 9*a* and 9*b* the housing 82 is shown in cross-section. The bottom of the housing 82 is thicker to the left in the figures than it is to the right in the figures. The advantage obtained by this variation of thickness is that the rolled spring 84 touches the contact part 87 at the same height (same point) all the time. Thus, the reduction of the outer diameter of the rolled spring 84, which occurs when the roll of the rolled spring is unrolled by moving it from the position of FIG. 9*a* to the position of FIG. 9*b*, is compensated by the increased thickness of the bottom of the housing 82. It is to be understood that the above description and the accompanying figures are only intended to illustrate the present invention. It will be obvious to those skilled in the art that the invention can be varied and modified also in other ways without departing from the scope and spirit of the invention disclosed in the attached claims.

The invention claimed is:

1. A connector comprising:

a housing, a spring biased contact surface facing in a front direction of said connector for establishing a contact with a connector counterpart, said contact surface being movable within a working area against a spring force from a first rest position to a second connecting position by a force directed to the contact surface upon establishing a contact with a connector counterpart, and a rolled spring with an outer end protruding in said front direction of said connector, wherein said outer end is attached to the housing of said connector, whereby said rolled spring is at least partly unrolled when said contact surface is moved against the spring force.

2. The connector according to claim 1 wherein said rolled spring is a rolled strip spring.

3. The connector according to claim 1, wherein said rolled spring is a constant force spring having a substantially constant spring force within said working area.

4. The connector according to claim 1, further comprising a contact part which is movably arranged in said housing, wherein said contact surface is arranged on a front part of said contact part and said rolled spring presses against a rear part of said contact part.

5. The connector according to claim 4, further comprising a terminal protruding to an outside of the housing, and a conductive path along an inner wall of the housing in order to connect said terminal and said contact part to each other, wherein said rear part of the contact part against which said rolled spring presses comprises a surface which is inclined in such a direction that the spring force presses the contact part sideways against said conductive path.

6. The connector according to claim 4, further comprising an inclined surface along which said rolled spring is arranged to be unrolled when said contact surface is moved against the spring force, said inclined surface being inclined to compensate for a change in the outer diameter of the rolled spring during unrolling of the spring, such that the rolled spring constantly presses against the same point of the rear part of said contact part.

7. The connector according to claim 4 further comprising an intermediate part made of a conductive material and having in a first end a protrusion extending along said contact part and in a second end a terminal protruding to an outside of the housing, wherein said rear part of said contact part is shaped with an eave, with a first side touching the protrusion of said intermediate part, and with a second opposite side directed away from the protrusion of said intermediate part, and said rolled spring is arranged to press against said second side of the eave in order to press said eave against the protrusion of the intermediate part.

8. The connector according to claim 4 further comprising an intermediate part made of a conductive material and having in a first end protrusions and in a second end a terminal protruding to an outside of the housing, wherein grooves are formed in opposite sides of the contact part, and said protrusions are arranged into said grooves in order to allow the contact part to slide along said protrusions, and in order to establish a conductive path between the contact part and the terminal via said intermediate part.

9. The connector according to claim 8, wherein the rear part of said contact part comprises a surface which is inclined in such a direction that the spring force presses the contact part sideways and the walls of said grooves press against said protrusions of the intermediate part.

* * * * *